US008840204B2

(12) United States Patent
Bauer et al.

(10) Patent No.: US 8,840,204 B2
(45) Date of Patent: Sep. 23, 2014

(54) REFRIGERATING APPLIANCE AND DOOR FOR ONE SUCH APPLIANCE

(75) Inventors: Peter Bauer, Munich (DE); Christoph Becke, Grosskarolinenfeld (DE); Alexander Goerz, Aalen (DE); Hans-Reinhart Janssen, Giengen (DE); Ralf Spiller, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1544 days.

(21) Appl. No.: 10/543,118

(22) PCT Filed: Jan. 26, 2004

(86) PCT No.: PCT/EP2004/000638

§ 371 (c)(1),
(2), (4) Date: Mar. 31, 2006

(87) PCT Pub. No.: WO2004/065867

PCT Pub. Date: Aug. 5, 2004

(65) Prior Publication Data

US 2006/0202596 A1 Sep. 14, 2006

(30) Foreign Application Priority Data

Jan. 24, 2003 (DE) ..... 103 02 797

(51) Int. Cl.

| | |
|---|---|
| ***A47B 96/04*** | (2006.01) |
| ***F25D 23/02*** | (2006.01) |
| ***F25D 29/00*** | (2006.01) |
| *F25D 23/08* | (2006.01) |

(52) U.S. Cl.

CPC ..... *F25D 29/005* (2013.01); *F25D 2400/36* (2013.01); *F25D 23/028* (2013.01); *F25D 2400/18* (2013.01); *F25D 23/085* (2013.01)

USPC ..... 312/405

(58) Field of Classification Search

USPC ..... 312/405, 405.1, 401, 406, 116, 138.1, 312/321.5; 62/125–126

See application file for complete search history.

(56) References Cited

U.S. PATENT DOCUMENTS

| | | | | |
|---|---|---|---|---|
| 1,111,446 | A | | 9/1914 | Ellis |
| 3,310,794 | A | | 3/1967 | Lusebrink |
| 3,689,909 | A | | 9/1972 | Cotter |
| 4,072,486 | A | | 2/1978 | Joseph |
| 4,358,932 | A | * | 11/1982 | Helfrich, Jr. ..... 62/126 |

(Continued)

FOREIGN PATENT DOCUMENTS

| | | | |
|---|---|---|---|
| DE | 3708722 | * | 10/1987 |
| DE | 4204045 | A1 | 8/1993 |

(Continued)

OTHER PUBLICATIONS

International Search Report PCT/EP2004/000638.

*Primary Examiner* — Hanh V Tran
(74) *Attorney, Agent, or Firm* — Nixon & Vanderhye P.C.

(57) ABSTRACT

A refrigerating appliance door having an inner wall and an outer wall interconnected along their longitudinal edges. A window is cut out of an edge of at least the outer wall in which at least one display element can be viewed when the door is shut. The display element is mounted on an operating screen which is fixed to a front upper edge of the refrigerating appliance body.

12 Claims, 4 Drawing Sheets

(56) References Cited

U.S. PATENT DOCUMENTS

| | | | | | |
|---|---|---|---|---|---|
| 4,966,004 | A | * | 10/1990 | Midlang et al. | 62/125 |
| 5,533,311 | A | * | 7/1996 | Tirrell et al. | 312/405 |
| 6,098,411 | A | * | 8/2000 | Jeon | 62/125 |
| 6,101,819 | A | * | 8/2000 | Onaka et al. | 62/125 |
| 6,289,908 | B1 | * | 9/2001 | Kelsey | 312/324 |
| 6,405,544 | B2 | * | 6/2002 | Hiraoka et al. | 62/127 |
| 6,827,410 | B2 | * | 12/2004 | Antos et al. | 312/405 |
| 7,031,144 | B2 | * | 4/2006 | Carter et al. | 312/405 |
| 7,216,944 | B2 | * | 5/2007 | Oyler et al. | 312/311 |
| 2003/0115891 | A1 | | 6/2003 | Raab et al. | |

FOREIGN PATENT DOCUMENTS

| | | | | |
|---|---|---|---|---|
| DE | 100 51 075 | A1 | | 4/2002 |
| JP | 01200183 | | * | 8/1989 |
| JP | 04068287 | | * | 3/1992 |
| JP | 05306864 | | * | 11/1993 |
| JP | 2001-1 41 352 | A | | 5/2001 |
| WO | WO 02/065036 | A1 | | 8/2002 |

* cited by examiner

Fig.1
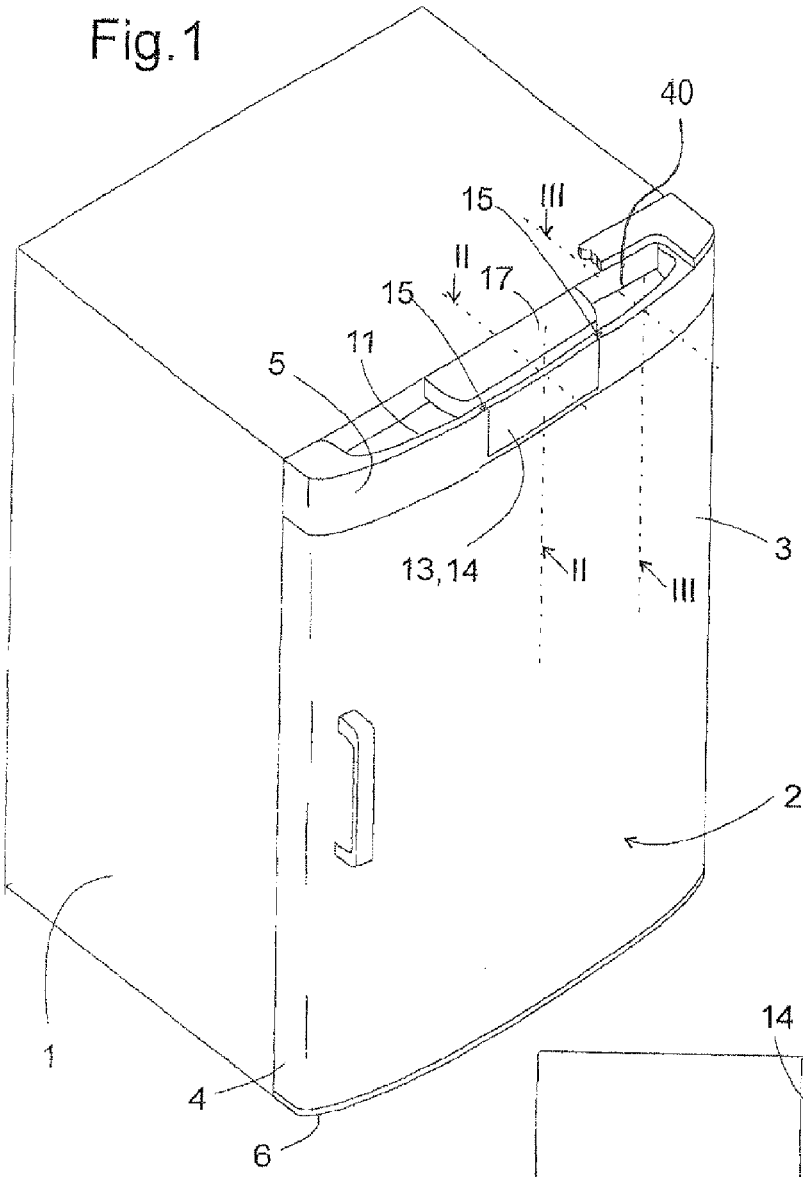
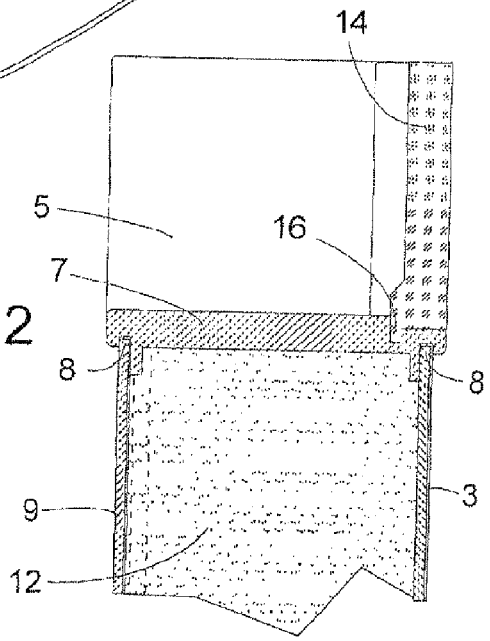
Fig. 2

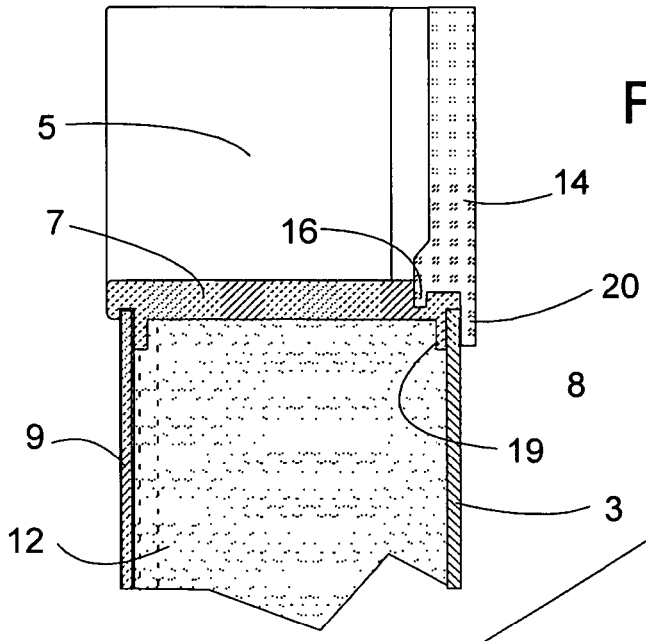
Fig.8
Fig.9
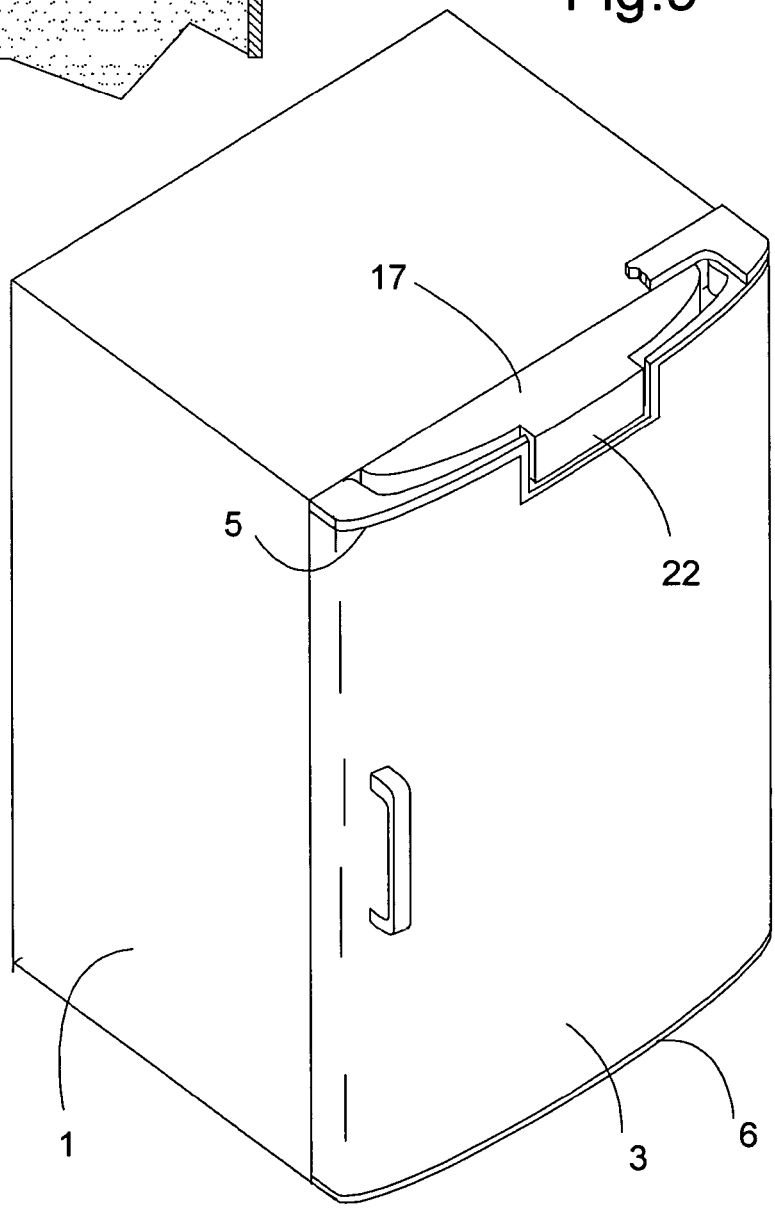

REFRIGERATING APPLIANCE AND DOOR FOR ONE SUCH APPLIANCE

This application claims priority to German Application No. 10302797.1, filed Jan. 24, 2003, the entire contents of which are hereby incorporated by reference.

The present invention relates to a refrigerating appliance, especially its door.

The housing of conventional refrigerating appliances comprises a heat-insulating body and a likewise heat-insulating door which abuts against a front of the body and extends mostly over the entire width of the body. In a known housing of a refrigerating appliance the door ends a few centimeters below the upper edge of the body to leave space for a control panel which is mounted on the upper edge of the body above the door, whose front ends flush with the front of the door and which serves to accommodate switches, push-buttons or other control elements for adjusting an operating status of the refrigerating appliance as well as display elements which provide information on operating parameters of the refrigerating appliance in an accessible position clearly visible for the user.

In order to satisfy the taste of the widest possible range of customers, it is desirable for the manufacturers of refrigerating appliances to be able to supply refrigerating appliances with different appearances, where particular importance is attached to the door as the most striking part of the refrigerating appliance. One possibility for modifying the appearance is to enlarge the door such that it covers the body of the refrigerating appliance as far as its upper edge, including the control panel attached thereto. However, this has the result that the convenient operation and visibility of the control panel are lost.

It is the object of the invention to provide a door for a refrigerating appliance or a refrigerating appliance where the door is raised up to the upper edge of the body without at least the visibility of control elements attached to a front side of the body being lost when the door is closed.

The viewing window can extend over the total thickness of the door; however, since in general no thermal insulation is required in the edge zone of the door where the viewing window is formed, it is sufficient if the inner wall of the door which together with the outer wall encloses the heat-insulating intermediate space of the door, is no larger than necessary to seal the interior of the body. The viewing window then only needs to be provided in the edge zone of the outer wall which projects over the edge of the inner wall, which substantially only has an aesthetic function.

The insulating intermediate space between the inner and outer wall is preferably closed on one side by an end element affixed to the edge of the outer wall in which the viewing window is cut out and an edge of the inner wall, which follows the contour of the at least one viewing window formed in the outer wall.

The viewing window can be completely open so that control and display elements arranged on a control panel of the body located therebehind can not only be viewed but can also be touched by hand.

In order to provide a smooth, easy-to-clean front of the refrigerating appliance, it is preferable if a transparent pane is arranged in the viewing window. Such a pane prevents control elements attached therebehind from being directly actuated when the door is open. However, the operation of the control elements is only of minor importance compared with the visibility of the display elements since the control elements are only rarely actuated whereas the free visibility of the display elements at all times is important so that defective operating states or functional disturbances of the refrigerating appliance can be identified at all times, even when the door is closed.

The transparent pane can be formed in one piece with the end element or it can be inserted into a window cut-out of the end elements. In order to ensure that the pane abuts against the door over its entire edge, especially if the outer wall is arched in the area of the viewing window, it is appropriate if the pane is mounted under pre-stress. Locating means for locating the window on the door, which act centrally on the pane, are especially desirable for this purpose.

The pane can be made of a highly transparent material so that it allows an unhindered view of control and display elements of any kind located therebehind.

The pane can also be made of an opaque material; this is especially appropriate if the pane is constructed in one piece with the end element which for its part is preferably not transparent; provided that the opacity is not too great, such a pane especially allows self-illuminating display elements located a short distance behind the pane to be identified without any difficulty.

At least part of the back of the pane is preferably provided with a non-transparent decoration.

Further features and advantages of the invention are obtained from the following description of exemplary embodiments with reference to the appended figures. In the figures:

FIG. 1 is a perspective view of a refrigerating appliance according to a first embodiment of the invention;

FIG. 2 is a section through the upper region of the door of the refrigerating appliance from FIG. 1 at the height of the window;

FIG. 8 is a section similar to that of FIG. 2 through the door from FIG. 6; and FIG. 9 is a perspective view of a refrigerating appliance according to a fourth embodiment of the invention.

Figure 3:
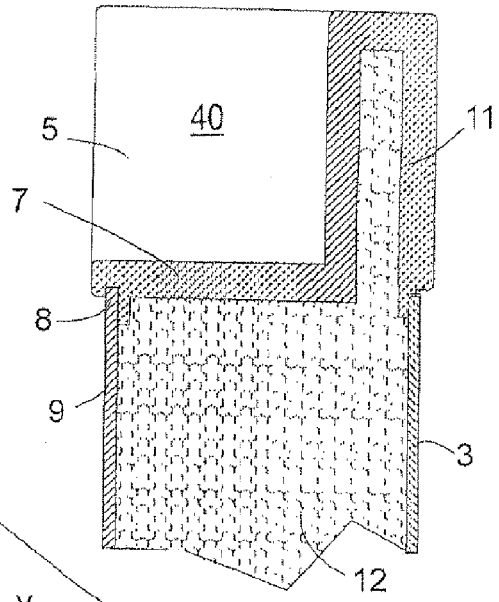
FIG. 3 is a section through the upper region of the door of the refrigerating appliance from FIG. 1 in a sectional plane remote from the window, parallel to the sectional plane of FIG. 2.

FIG. 1 shows a perspective view of a refrigerating appliance according to a first embodiment of the invention. A door 2 abuts against a body 1 of the refrigerating appliance. The door 2 is constructed in a manner known per se from a piece of sheet metal which is bent along a plurality of vertical lines to form an outer wall 3, side flanks 4 and lugs facing the front of the body 1, which cannot be seen in the figure, and a plastic inner wall 9 (see FIGS. 2, 3) whose vertical edges are affixed to the lugs. The inner and outer wall delimit an intermediate space 12 filled with insulating foam material. The horizontal edges of the inner and outer wall 3, 9 are not in contact with each other but are connected by upper and lower end elements 5, 6 which are made of plastic by injection moulding.

FIG. 2 shows the upper end element 5 and its surroundings in a vertical section along the plane denoted by II-II in FIG. 1 and FIG. 3 shows a similar section along the plane III-III. The upper end element 5 comprises a horizontal plate 7 which is provided with grooves 8 on its underside in which the upper edges of the outer wall 3 and the inner wall 9 located at respectively the same level engage. A recess 40 formed between the rear side of the outer wall piece 11 and an upper side of the plate 7 can be grasped by a user to open and close the door. This recess 40 extends across almost the entire width of the top of the door.

As shown in FIG. 3, the sheet-metal outer wall 3 is extended upwards by an outer wall piece 11 of the end element 5 in one piece with the plate 7. The hollow interior of the outer wall piece 11 is filled with insulating foam 12 as is the intermediate space between the outer wall 3 and inner wall 9. A window cut-out 13 is formed in this outer wall piece 11 and a pane 14 of highly transparent plastic such as PMMA or PC is mounted therein. The pane 14 has springs 15 at its outer edges which respectively engage in vertical grooves of the outer wall piece 11. A claw 16 moulded on the lower edge of the pane 14 is inserted in a recess on the upper side of the plate 7.

Visible through the pane 14 is a control panel 17 mounted at the upper front edge of the body 1 whereon especially display elements for displaying an operating state of the refrigerating appliance such as a digital temperature display, a fault warning light or the like are mounted.

Figure 4:
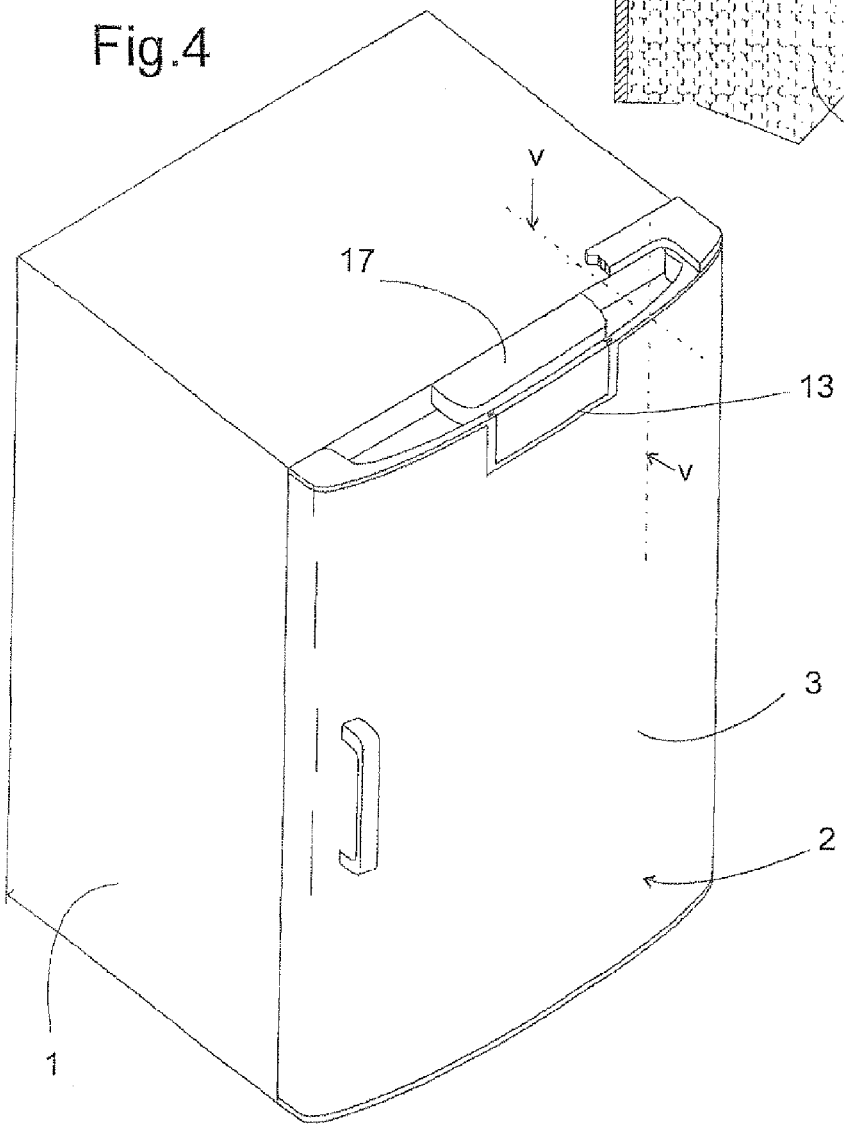
FIG. 4 is a perspective view of a refrigerating appliance according to a second embodiment of the invention.
Figure 5:
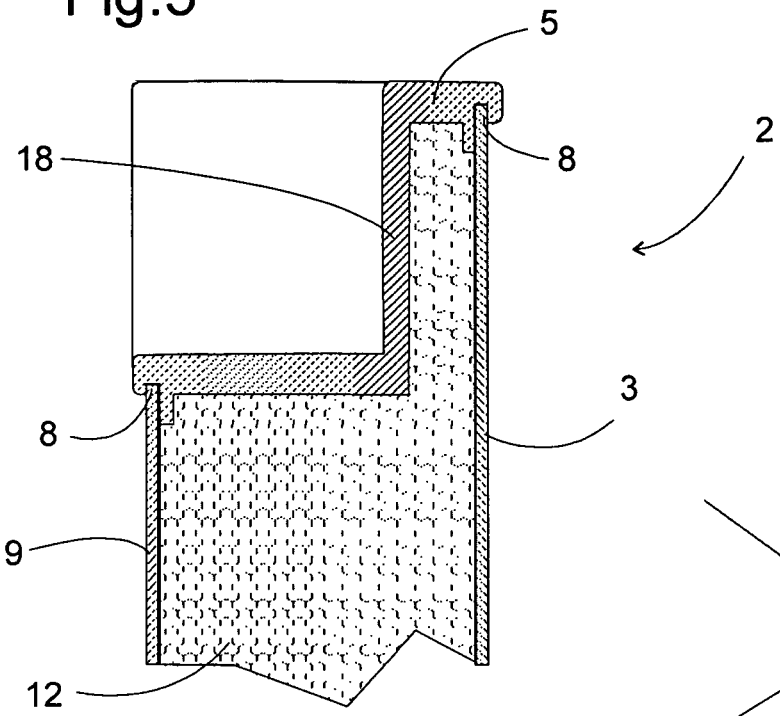
FIG. 5 is a section through the upper region of the door from FIG. 4.

The embodiment in FIG. 4 differs from that in FIG. 1 in that the sheet-metal outer wall 3 is extended upwards on both sides of the window cut-out 13 so that the vertical outer wall pieces from FIG. 3 are omitted. Instead the cross-section shown in FIG. 5 is obtained in the plane marked V-V in FIG. 4 which corresponds to the plane III-III in FIG. 1. The outer wall 3 extends as far as directly on the upper edge of the door 2 where it engages in a groove 8 of the upper end element 5. A vertical flank 18 of the upper end element 5 compensates for the height difference between the outer wall 3 and the inner wall 9.

A vertical section through the door 4 at the height of the window cut-out 13 does not differ from the section shown in FIG. 2 and is thus not shown on its own in a figure.

Figure 6:
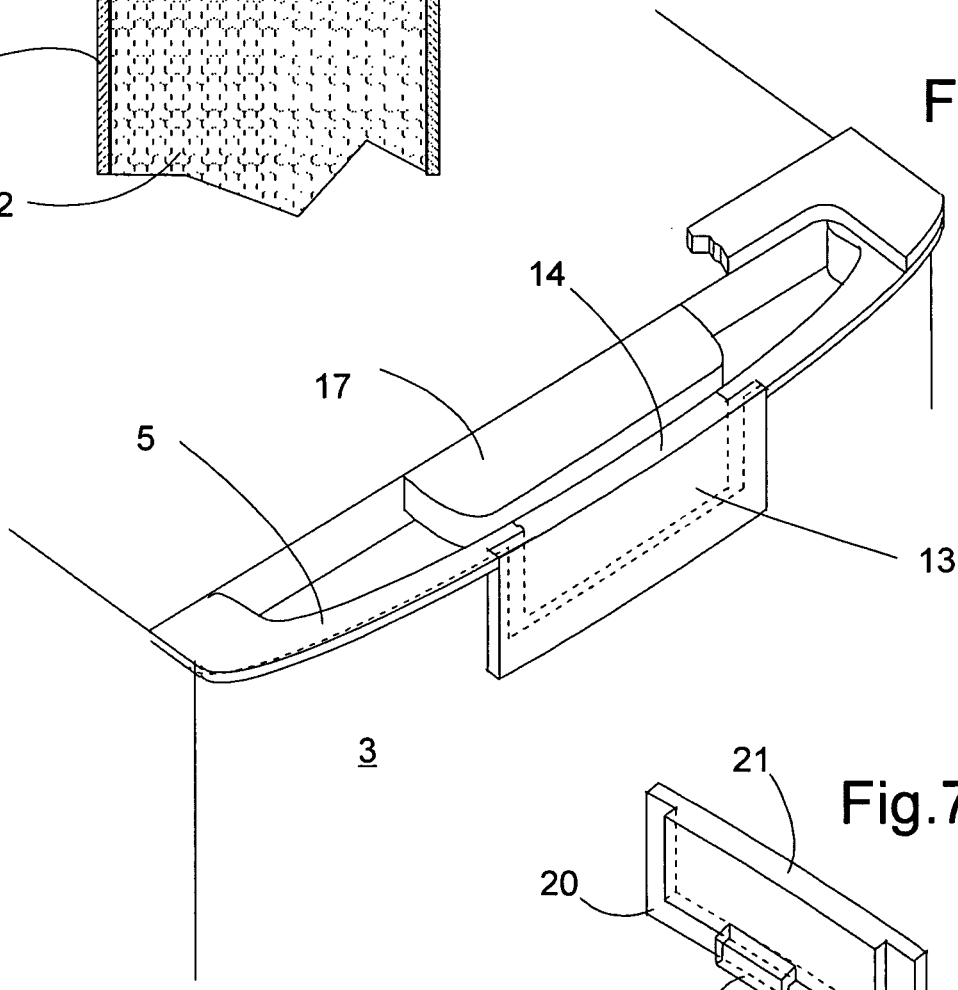
FIG. 6 is a perspective partial view of the upper front region of a refrigerating appliance according to a third embodiment of the invention.

FIG. 6 shows another perspective part view of the housing of a refrigerating appliance and its door according to the invention. In this embodiment the sheet-metal outer wall 3 is identical to that in FIG. 4. The upper end element 5 differs from the embodiment from FIG. 4 in that in the vicinity of the window cut-out 13 its front edge ends flush with the outer wall 3 as can especially be seen in the sectional view in FIG. 8. In this case, a groove 8 in which the upper edge of the outer wall 3 is inserted, is formed on the inside by a cross-piece 19 which projects downwards from the horizontal plate 7 of the end element 5 and on the outside by a lower edge region 20 of the pane 14 which projects slightly to the front over the outer wall 3.

Figure 7:
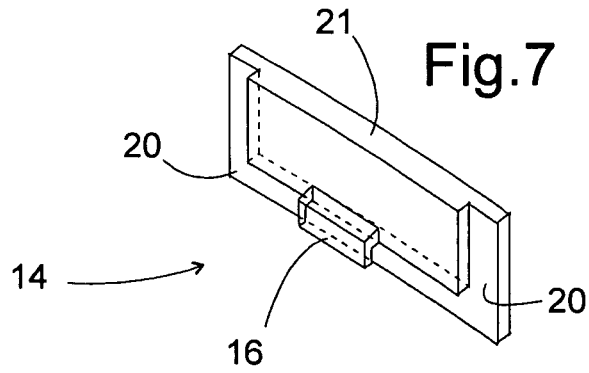
FIG. 7 is a perspective view of the pane of the door from FIG. 6.

FIG. 7 shows a perspective view of the pane 14 seen from its back facing the body 1. A comparatively thick-walled central region 21, surrounded on three sides by the edge zone 20 can be seen, whose dimensions are such that it engages in positive contact in the window cut-out 13 of the end element 5 whereas the edge zone 20 comes to rest externally on the outer wall 3. A short powerful claw 16 projects downwards from the lower edge of the central region 21 in order to engage in a recess of the plate 7. Like the outer wall 3, the pane 14 is slightly cylindrically arched with a convex outer side. The curvature of the pane 14 is greater than that of the outer wall 3 so that if the edge regions 22 each abut with their side edges against the outer wall 3, the interposed region of the pane 14 projects slightly from the outer wall 3 in a stress-relieved state. Only when the plane 14 is slightly elastically deformed by pressing on its central area does the claw 14 come to rest exactly over the recess of the plate 7 so that it can be located from above in the recess and the pane 14 can thereby be anchored. It can thus be ensured in a simple fashion that the entire edge region 22 of the window 14, especially its lower edge, abuts in positive contact against the outer wall 3 even when the curvature of the outer wall 3 has a slight scatter caused by the manufacturing.

On its inner side facing the outer wall 3 and the end element 5 the edge zone 20 is provided with a coloured non-transparent decoration adapted to the outer wall 3 or the end element 5, which covers the edge of the outer wall 3 in the vicinity of the window cut-out 13 so that slight dimensional deviations in this area between outer wall 3 and end element 5 remain invisible and do not appear as blemishes.

FIG. 9 shows a fourth embodiment of a refrigerating appliance according to the invention. The sheet-metal outer wall 3 only differs from that shown in FIG. 4 in that the grooves 8 on both sides of the window cut-out are omitted in FIG. 9. No window is inserted in the window cut-out, instead the control panel 17 affixed to the front upper edge of the body 1 is drawn so far forward in this area that it engages in the window cut-out and has a front face 22 flush with the outer wall 3 or the upper end element 5 towards the front. Since the front face 22 is not only freely visible when the door is closed, but can also be touched, control elements can suitably be attached thereon, which a user can actuate to regulate the operating state of the refrigerating appliance.

As a result of another embodiment not shown in a figure, the upper end element 5 and the pane 14 can be manufactured in one part from the same plastic material. In general, non-transparent plastic material pigmented in the colour of the outer wall 3 is used for the end element 5. However, its wall thickness can be reduced to such an extent in the area of the pane that it at least has a translucent effect. A luminous display attached in a control panel mounted behind the pane at a short distance from the pane locally causes the translucent pane itself to light up so that the operating state indicated by the display can be read off directly on the pane itself.

The invention claimed is:

1. A door for a refrigerating appliance, the refrigerator appliance having a body with a front side extending between an upper front edge and a lower front edge, an opening formed in the front side that is closeable by a door, and a control panel mounted on the upper front edge of the front side of the body, the door comprising:

an outer wall;

an inner wall;

said outer wall and said inner wall interconnected along their longitudinal and transverse edges forming a space therebetween to form a depth for the door;

an upper end element being attached to an upper transverse edge of the door, the upper end element including a plate extending horizontally between the inner and outer walls across the depth of the door and an outer wall piece that extends upward from a front edge of the plate, wherein a grasping recess is formed between a rear side of the outer wall piece and an upper surface of the plate, and wherein a viewing window is formed in the outer wall piece, the viewing window allowing a user visual access to a space behind the viewing window.

2. The door according to claim 1, having a rectangular outline and a pair of shorter rectangular sides and a pair of longer rectangular sides joining said shorter sides into said rectangular outline, wherein said viewing window is formed on one of said shorter rectangular sides of said door serving as said upper transverse edge.

3. The door according to claim 1, including a transverse edge of said outer wall and a corresponding transverse edge of said inner wall lie opposite one another and wherein said viewing window allows a user visual access over said depth of said door.

4. The door according to claim 3, wherein an upper edge of the outer wall extends upward across an outer side of the outer wall piece, and wherein said upper transverse edge of said outer wall has a viewing window formed therein corresponding to the viewing window formed in the outer wall piece.

5. The door according to claim 1, including an at least partially transparent pane arranged in said viewing window.

6. The door according to claim 5, including said pane formed integrally with said end element.

7. The door according to claim 5, wherein said pane is inserted in the viewing window formed in the outer wall piece.

8. The door according to claim 5, including said outer wall is arched at least in the area of said viewing window and said pane mounted under pre-stress.

9. The door according to claim 5, including locating means for acting centrally on said pane for locating said pane on said door.

10. The door according to claim 5, including a non-transparent decoration formed at least on a portion of the back of said pane.

11. The door according to claim 5, including said pane formed from a selected one of a highly transparent material and an at least partially opaque material.

12. A refrigerator appliance comprising:

a body with a back side, a front side extending between an upper front edge and a lower front edge, an opening formed in the front side, and a top surface extending to and between the back side and the front side, a control panel mounted on the upper front edge of the front side of the body, the control panel extending to a height such that no portion of the control panel extends higher than the top surface extending to and between the back side and the front side; and a door, the door being operable to close off the opening formed in the front side of the body and the door having an outer wall, an inner wall, the outer wall and the inner wall interconnected along their longitudinal and transverse edges forming a space therebetween to form a depth for the door, a grasping aperture being formed in a top edge of the door, the grasping aperture extending across substantially an entire width of the door, and the upper transverse edge of the door being formed with a viewing window extending over the depth of the door, wherein the door covers the body of the refrigerating appliance to its upper edge and wherein the control panel mounted on the upper front edge of the front side of the body of the refrigerating appliance is visible through the viewing window.

* * * * *